US005678767A

United States Patent [19]

Rahbar

[11] Patent Number: 5,678,767

[45] Date of Patent: Oct. 21, 1997

[54] FUEL INJECTOR WITH CONTAMINANT DEFLECTOR

[75] Inventor: Mehran K. Rahbar, Chesapeake, Va.

[73] Assignee: Siemens Automotive Corporation, Auburn Hills, Mich.

[21] Appl. No.: 615,927

[22] Filed: Mar. 14, 1996

[51] Int. Cl.[6] ..... B05B 1/14

[52] U.S. Cl. ..... 239/533.2; 239/575; 239/585.1; 239/DIG. 23

[58] Field of Search ..... 239/533.1–533.14, 239/585.1, 585.4, 596, 584, 120, 121, 122, 462, 590, 575, DIG. 23

[56] References Cited

U.S. PATENT DOCUMENTS 2,602,005 7/1952 Weldy ..... 239/575

4,923,169 5/1990 Grieb et al. ..... 239/585.1

5,238,192 8/1993 McNair ..... 239/575

5,423,489 6/1995 Wood ..... 239/575

*Primary Examiner*—Andres Kashnikow

*Assistant Examiner*—Lisa Ann Douglas

*Attorney, Agent, or Firm*—Russel C. Wells

[57] ABSTRACT

A generally frusto-conical contaminant particle deflector is mounted within a valve body of an automotive engine fuel injector, surrounding a fuel injector valve element. An inner clearance space between the valve element and an open end of the deflector receives fuel flow when the injector valve element is moved to allow fuel flow. Contaminant particles are caused to move along a path extending radially out of the fuel stream and into a dead zone outside the perimeter of the deflector where they tend to remain so as to avoid any effects on the performance of the fuel injector.

6 Claims, 2 Drawing Sheets

FUEL INJECTOR WITH CONTAMINANT DEFLECTOR

BACKGROUND OF THE INVENTION

This invention concerns fuel injector valves, and more particularly the avoidance of the adverse effects of contaminants on proper fuel flow through the injector valve.

Modern automobile engines are typically fuel injected, i.e., pressurized fuel from a fuel rail is communicated to fuel injector valves, which when opened spray a fuel charge into the air intake manifold at points proximate each intake valve. The fuel injector values are precision devices having a needle-shaped valve element operated electronically to be moved off a valve seat for precisely timed intervals to cause a desired volume of fuel to be inducted into each engine cylinder during each combustion cycle.

The performance of the fuel injectors can be affected by contaminant particles which can lodge in clearance spaces to prevent valve movement onto the valve seat, allowing continued fuel flow after the valve element is supposed to have been moved onto the valve seat. The contaminant particles can also prevent fuel flow or reduce fuel flow when the valve element is unseated, or may disrupt the proper fuel spray pattern.

Fuel filters are used successfully to prevent the entrance of containment particles from the fuel system during vehicle operation, but such particles are often generated during the manufacture of the injectors. Made with rigorous care and clean room conditions, injector manufacture itself involves welding, staking, crimping, etc., which inevitably generate contaminant particles. Despite careful post manufacture testing, some injectors with contaminant particles will escape detection and be placed in service, where these particles may later cause injector failure.

A filter screen disc just upstream of the valve seat can keep the particles out of the seat area, but even the presence of the particle on the filter screen can substantially restrict fuel flow.

It is the object of the present invention is to minimize the effect of undetected contaminant particles in fuel injector valves.

SUMMARY OF THE INVENTION

The above recited object of the present invention is accomplished by installing a deflector or shield in the fuel stream path followed by the particles so as to intercept the particles and prevent them from entering the critical seating area of the valve element.

The deflector geometry creates a dead zone in the fuel flow stream into which any particles are deflected, which zone tends to cause any particles to remain trapped there and to not subsequently enter critical areas where they might interfere with proper injector operation.

The deflector preferably takes the form of a generally frusto-conical shape installed in the injector valve body surrounding the valve element at a location just upstream of a guide plate. The guide plate itself has openings for receiving fuel flow. A conical portion of the deflector terminates in a cylindrical end portion projecting upstream into the fuel flow with a clearance space between the valve element and the inside of the cylindrical end.

Any contaminant particle carried in the fuel stream tends to follow a path curving inward towards the guide plate openings, which flow path causes the particle to move along a path which arcs out beyond the outside of the deflector, and is thereby directed into a dead zone outward of the deflector perimeter and lying within a bore in the injector valve body in which the deflector is mounted.

The particle will thus remain in that zone, whereat it will have no effect on the fuel injector performance.

DETAILED DESCRIPTION

Figure 1:
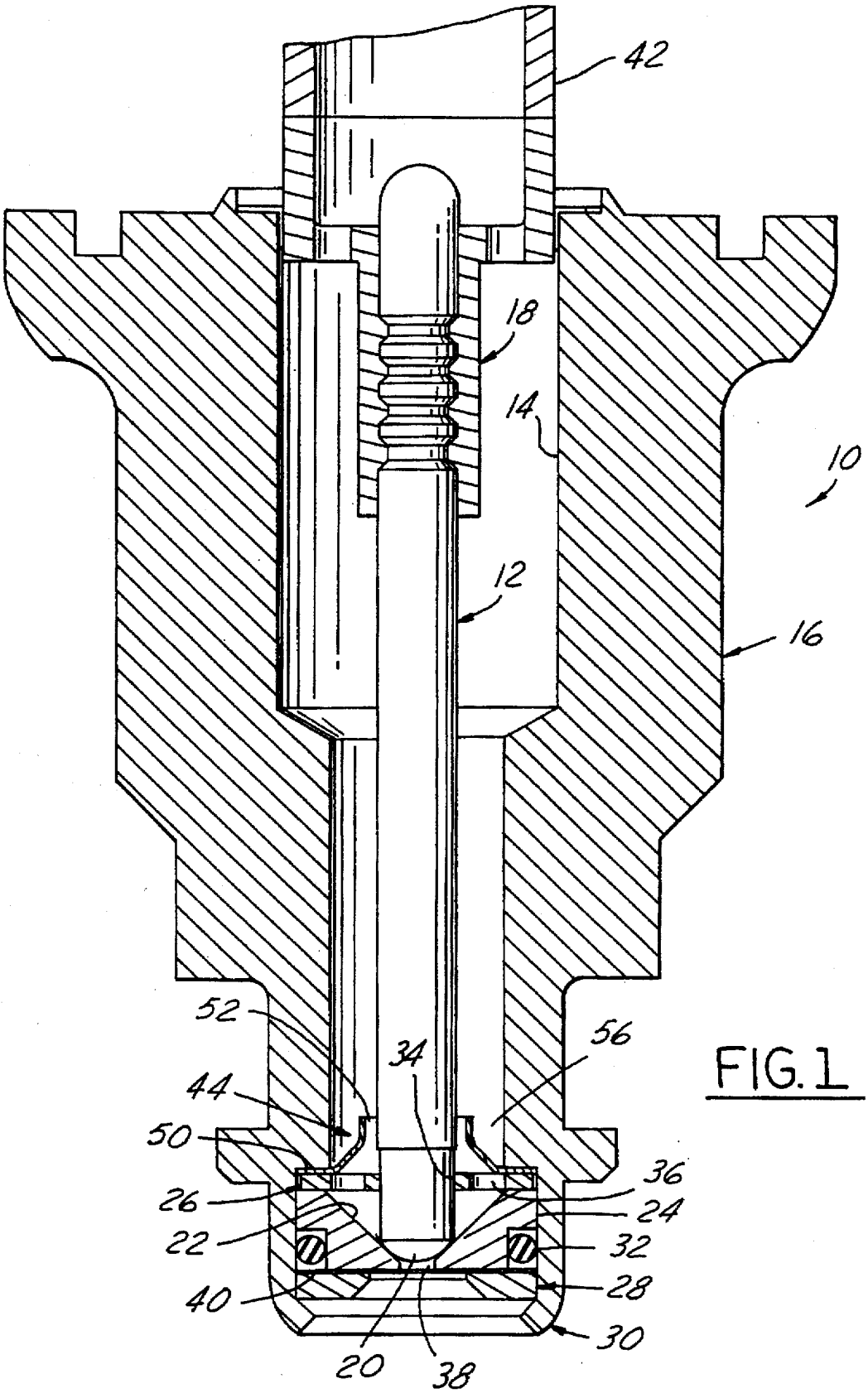
FIG. 1 is an enlarged partially sectional fragmentary view of a fuel injector showing a particle deflector according to the present invention installed therein.
Figure 2:
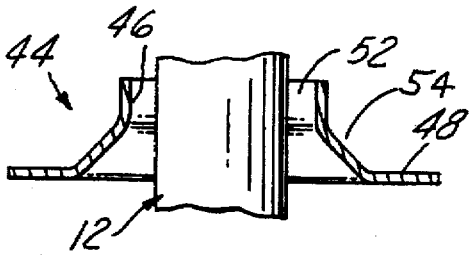
FIG. 2 is a further enlarged sectional view of the particle deflector shown in FIG. 1.
Figure 3:
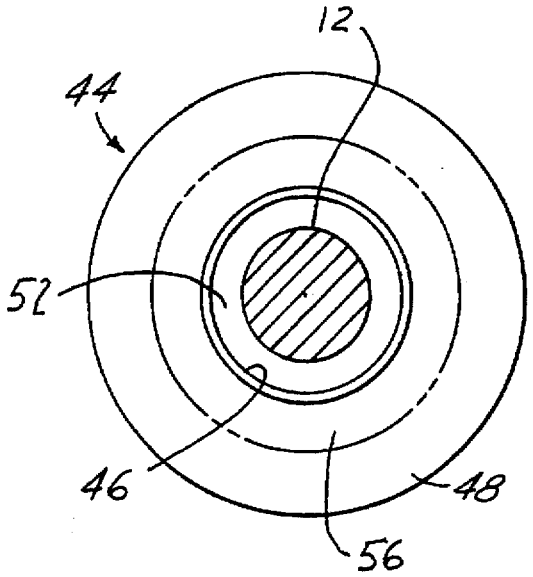
FIG. 3 is an end view of the particle deflector shown in FIGS. 1 and 2.

In the following detailed description, certain specific terminology will be employed for the sake of clarity and a particular embodiment described but it is to be understood that the same is not intended to be limiting and should not be so construed inasmuch as the invention is capable of taking many forms and variations within the scope of the appended claims.

Referring to the drawings, an enlarged view of the lower portion of a fuel injector 10 is shown. The present invention is applicable to a variety of fuel injector configurations which include an elongated needle-shaped a valve element 12 disposed in a bore 14 within a valve body 16.

One end of the valve element 12 is crimped to an armature 18.

The tip 20 of the valve element 12 is rounded and adapted to be spring urged to move onto a conical surface 22 of a valve seat 24.

The valve seat 24 is held between a guide piece 26 and a backup washer 28 by a crimped end 30 of the valve body 16.

An O-ring seal 32 prevents the escape of fuel from within bore 14.

The guide 26 has a central opening 34 slidably receiving the lower end of the valve element 12.

A series of outwardly spaced flow openings 36 allow fuel to pass to a central outlet 38 in the fuel seat 24. A thin metal orifice disc 40 is held between the lower end of the valve seat 24 and backup washer 28 sets the flow resistance and thus the volume of flow passing out of the fuel injector during the interval when the valve element 12 is lifted off the valve seat surface 22.

The armature 18 is magnetically attracted to abut against the end of an inlet tube 42 when the electronic controls cause a solenoid operation (not shown) to be energized, lifting the valve element 12 to cause the end 20 to move off the seat surface 22, in the manner well known in the art.

Pressurized fuel is communicated to the space within bore 14, so that fuel flow through the orifice 40 immediately takes place and continues for the interval during which the armature 18 is held against the inlet tube end 42.

Upon deenergization of the solenoid, a spring (also not shown) acting within the cupped end of the armature 18 immediately forces the valve element 12 downwardly to cause the tip 20 to be reseated on surface 22 to stop further fuel flow.

The above components and others included in typical fuel injectors are well known to those skilled in the art, and hence further details are not here shown or described, According to the present invention, a generally frusto-conical flanged particle deflector 44 is mounted within the valve body bore 14, surrounding the lower end of the valve element 12, which is received into the generally cylindrical open end 46 of the deflector 44.

A radial flange 48 at the base of the deflector 44 allows the deflector 44 to be secured between an inner step or shoulder 50 formed in the valve body bore 14 and the guide 26.

An annular inner clearance space 52 between the outside of the valve element 12 and the inside of the deflector open end 46 allows directing of fuel flow through the interior of the deflector 44 to the guide openings 36 and valve seat opening 38.

The clearance space 52 is much smaller than the space between the bore 14 and the outside of the open end 46 so that fuel flow curves radially inward in passing into the clearance space 52.

A frusto-conical flared portion 54 extends from the open end 46 to the radial flange 48. This creates a blind space 56 within the valve body bore 14 and outside the perimeter of the deflector 44.

Figure 4:
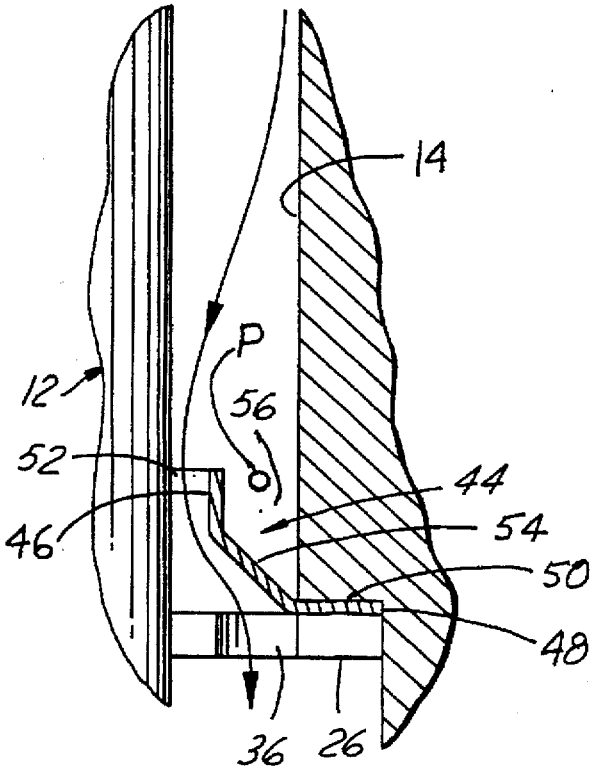
FIG. 4 is a diagram of a portion of the injector valve shown in FIG. 1 depicting the flow path of a contaminant particle.

FIG. 4 shows the flow stream direction which curves towards the clearance space 52. In so curving, any contaminant particle P which is entrained in the fuel flow tends to move along a curved path radially outside of the deflector open end by centrifugal force acting on the particle in moving along the curved path and to not be drawn into the open end 46 of the deflector 44 with the fuel because of its greater inertia. Thus, the particle P will be deflected into the dead zone 56.

Since there is no flow out of the dead zone 56, the particle will tend to remain there, where it presents no problem.

In the event the particle P does come out of the dead zone 56 due to some transient effect, it will again be directed into the dead zone in the same fashion to prevent its lodging in a critical space.

The deflector 44 can advantageously be formed by deep drawing process from 0.145–0.160 thick 201 SS and afterwards tempered.

The simple configuration of the deflector, which does not have easily fouled small openings, and which sets up a flow pattern directing particles away from its open end results in a minimization of the effects of any undetected contaminant particles which may inadvertently be present when the injector is placed in service.

This result is achieved by a simple device which will not add appreciably to the cost of manufacture of the injector.

I claim:

1. In a fuel injector of the type including an elongated valve element and movable onto and off a valve seat to control the flow of fuel mounted within a bore in a valve body enclosing said valve element out of said fuel injector, the improvement comprising:

a deflector comprising an element mounted in said valve body bore and surrounding said valve element with an annular clearance space therebetween allowing fuel flow therethrough, said deflector having an open end projecting away from said valve seat, and a portion flaring radially out from said open end and blocking fuel flow around said deflector, whereby a dead zone is created tending to capture contaminant particles moved radially out from a fuel flow stream curving inwardly towards said annular clearance space.

2. The fuel injector according to claim 1 wherein said deflector is generally frusto-conical in shape.

3. The fuel injector according to claim 2 wherein said open end of said deflector is generally cylindrical and said outwardly flaring portion includes a frusto-conical portion and a radially extending flange.

4. The fuel injector according to claim 3 wherein said radial flange is held against a shoulder in said valve body bore.

5. The fuel injector according to claim 4 wherein said fuel injector includes a valve guide having central opening receiving said valve element and a series of openings arranged radially around said central opening to allow fuel flow, said guide fixed abutting against a side of said radial flange opposite said side abutting said shoulder in said valve body bore.

6. A method of reducing the effects of contaminant particles in a fuel injector for automotive engines of the type having a needle-shaped valve element axially movable in an internal bore in a valve body, said valve element movable off a valve seat to allow fuel under pressure in a valve body bore to flow out through an opening in said valve seat, said valve element movable onto said valve seat to prevent flow of fuel out of said opening, said method comprising the steps of:

positioning a deflector around said valve element having an open end portion projecting upstream and with a clearance space therebetween to allow fuel flow therethrough while preventing fuel flow around the outside of said deflector to create a dead zone outside said projecting portion and cause particles to move outside said projecting end portion as said fuel flows radially inward in passing into said clearance space.

* * * * *